US008512019B2

(12) United States Patent
Kakiuchi et al.

(10) Patent No.: US 8,512,019 B2
(45) Date of Patent: Aug. 20, 2013

(54) SCREW COMPRESSION APPARATUS

(75) Inventors: Tetsuya Kakiuchi, Takasago (JP); Yasushi Amano, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 337 days.

(21) Appl. No.: 12/995,076

(22) PCT Filed: Jun. 3, 2009

(86) PCT No.: PCT/JP2009/060120

§ 371 (c)(1),
(2), (4) Date: Nov. 29, 2010

(87) PCT Pub. No.: WO2009/150967

PCT Pub. Date: Dec. 17, 2009

(65) Prior Publication Data

US 2011/0076174 A1 Mar. 31, 2011

(30) Foreign Application Priority Data

Jun. 13, 2008 (JP) ..... 2008-155107

(51) Int. Cl.
*F03C 4/00* (2006.01)
*F04C 15/00* (2006.01)
*F04C 2/00* (2006.01)

(52) U.S. Cl.
USPC ..... 418/98; 418/88; 418/97; 418/99; 418/201.1; 418/201.2; 418/270; 418/DIG. 1

(58) Field of Classification Search
USPC ..... 418/201.1–201.2, 206.1, 206.6–206.8, 418/88–89, 97–100, 102, 104, 270, DIG. 1
See application file for complete search history.

(56) References Cited

U.S. PATENT DOCUMENTS 3,734,653 A * 5/1973 Edstrom et al. ..... 418/88
3,975,123 A * 8/1976 Schibbye ..... 418/97

(Continued)

FOREIGN PATENT DOCUMENTS

GB 2 008 684 6/1979
JP 10 26093 1/1998

(Continued)

OTHER PUBLICATIONS

International Search Report issued Sep. 15, 2009 in PCT/JP09/060120 filed Jun. 3, 2009.

(Continued)

*Primary Examiner* — Theresa Trieu
(74) *Attorney, Agent, or Firm* — Oblon, Spivak, McClelland, Maier & Neustadt, L.L.P.

(57) ABSTRACT

In a screw compression apparatus in which shaft sealing members (13, 14) isolate a bearing space (7, 8) from a rotor chamber (5) and a lubricating fluid separating collector (3) separates the rotor lubricating fluid from the target gas discharged by the screw compressor (2), rotor lubricating fluid separated by the lubricating fluid separating collector (3) is introduced into the rotor chamber (5) via a rotor lubricating flow channel (25), and a bearing lubricating system (17) supplies a bearing lubricating fluid to the bearing space (7, 8). The bearing lubricating fluid flowing out from the bearing space (7, 8) is cooled and returned to the bearing space (7,8). A part of the target gas may be supplied to the shaft sealing members (13, 14) at a location between carbon rings of the shaft sealing members.

7 Claims, 4 Drawing Sheets

(56) References Cited

U.S. PATENT DOCUMENTS

| | | | | |
|---|---|---|---|---|
| 4,394,113 | A * | 7/1983 | Bammert | 418/98 |
| 5,135,374 | A * | 8/1992 | Yoshimura et al. | 418/201.2 |
| 5,727,936 | A | 3/1998 | Eriksson et al. | |

FOREIGN PATENT DOCUMENTS

| | | |
|---|---|---|
| JP | 10 501862 | 2/1998 |
| JP | 10-89270 | 4/1998 |
| JP | 3803812 | 8/2006 |
| WO | 2006 013636 | 2/2006 |

OTHER PUBLICATIONS

Office Action issued Jan. 19, 2012, in Russian Patent Application No. 2011100838/06(001065) with English translation.

Office Action issued Dec. 21, 2012 in Chinese Patent Application No. 200980122341.3 (with English translation).

* cited by examiner

SCREW COMPRESSION APPARATUS

FIELD OF THE INVENTION

The present invention relates to a screw compression apparatus.

BACKGROUND ART

Traditionally, commonly used is an oil cooled screw compressor which is cooled with cooling oil between screw rotors and between the screw rotors and rotor chamber. In a conventional oil cooled screw compressor, if the target gas to be compressed is carbon hydrate series gas, the target gas dissolves into the cooling oil to reduce viscosity of the cooling oil, and then an insufficient lubrication of a bearing can be caused to damage the bearing. Further, if the target gas is corrosive gas, the target gas can damage the bearing in the conventional screw compressor.

Patent literature 1 describes a technique to separate target gas dissolved in cooling oil by reducing pressure of target gas discharged from screw compressor in a depression tank. However, it is not able to significantly reduce pressure, and so the deaeration is not always sufficient in the apparatus in the patent literature 1.

PRIOR ART LITERATURE

Patent Literature 1: JP H10-26093 A

SUMMERY OF THE INVENTION

Technical Problem

In view of the above problem, an object of the present invention is to provide a screw compression apparatus in which a property of target gas to be compressed does not affect a lifespan of a bearing.

Solution to the Problem

In order to achieve the above object, a screw compression apparatus according to the present invention comprises: a screw compressor in which a rotor shaft of a screw rotor that is rotatably housed to compress a target gas together with a rotor lubricating fluid in a male/female interlocking arrangement in a rotor chamber formed in a housing is held by a bearing arranged in a bearing space formed in the housing adjacently to the rotor chamber, and which includes a shaft sealing member that isolates the bearing space from the rotor chamber; a lubricating fluid separating collector which separates the rotor lubricating fluid from the target gas discharged from the screw compressor; a rotor lubricating fluid feeding means which introduces the rotor lubricating fluid separated by the lubricating fluid separating collector into the rotor chamber; and a bearing lubricating system which supplies a bearing lubricating fluid to the bearing space, and returns into the bearing space the bearing lubricating fluid discharged from the bearing space.

According to this configuration, the rotor lubricating fluid for lubricating the screw rotor and rotor chamber and bearing lubricating fluid for lubricating the bearing of the rotor shaft are being fluids isolated from each other and circulated in different systems independently. Thereby, contact of the bearing lubricating fluid and the target gas can be mostly eliminated so that the bearing lubricating fluid is prevented from deteriorating so as to prevent lifespan reduction of the bearing.

Further, the screw compression apparatus of the present invention may comprise a rotor lubricating flow channel through which the rotor lubricating fluid collected in the lubricating fluid separating collector is returned into the rotor chamber.

According to this configuration, the rotor lubricating fluid can be circulatedly used and therefore the rotor lubricating fluid can be easily cooled down.

Further, in the screw compression apparatus of the present invention, the bearing lubricating fluid may be supplied also to the shaft sealing member.

According to this configuration, the bearing lubricating fluid is also used as sealing fluid which enhances sealing of the shaft sealing member, and therefore intrusion of the target gas into the bearing space can be surely prevented.

Further, in the screw compression apparatus of the present invention, the shaft sealing member may be configured to connect the rotor chamber and bearing space to each other thorough a plurality of narrow gaps, and a part of the target gas from which the rotor lubricating fluid is separated in the lubricating fluid separating collector may be supplied into midstream in the shaft sealing member.

According to this configuration, the target gas from which the rotor lubricating fluid is separated is fed into midstream in the shaft sealing member, and therefore the supplied target gas leaks out from a small gap formed by the shaft sealing member to a lower pressure side so as to prevent the target gas including rotor lubricating fluid from flowing into the bearing space out from the rotor chamber. Since the target gas flow into the bearing space through the shaft sealing member is extremely little, the target gas never deteriorates bearing lubricating fluid and never causes a corrosion of the bearing.

Further, in the screw compression apparatus of the present invention, the screw compressor may have a slide valve which controls a discharging position of the target gas from the rotor chamber.

In a case of using a slide valve, it is difficult to make a screw compressor as in oil free configuration, and therefore conventional screw compressor can not adapt to corrosive gas and the like. However, according to the present invention, even in case of using a slide valve, a life span of the bearing can be ensured.

Further, in the screw compression apparatus of the present invention, the bearing lubricating fluid may also serves as a working medium of the slide valve.

According to this configuration, less accessory equipment for circulatingly feeding fluid is needed.

Advantageous Effect of the Invention

According to the present invention, the rotor chamber and the bearing space of the screw compressor are separated from each other with the shaft sealing member, and are supplied different fluid for lubrication and cooling. Therefore, little to no target gas which is compressed in the screw compressor contacts with the bearing and bearing lubricating fluid. Consequently, the lifespan of the bearing is not affected by a property of the target gas.

DESCRIPTION OF EMBODIMENT

Figure 1:
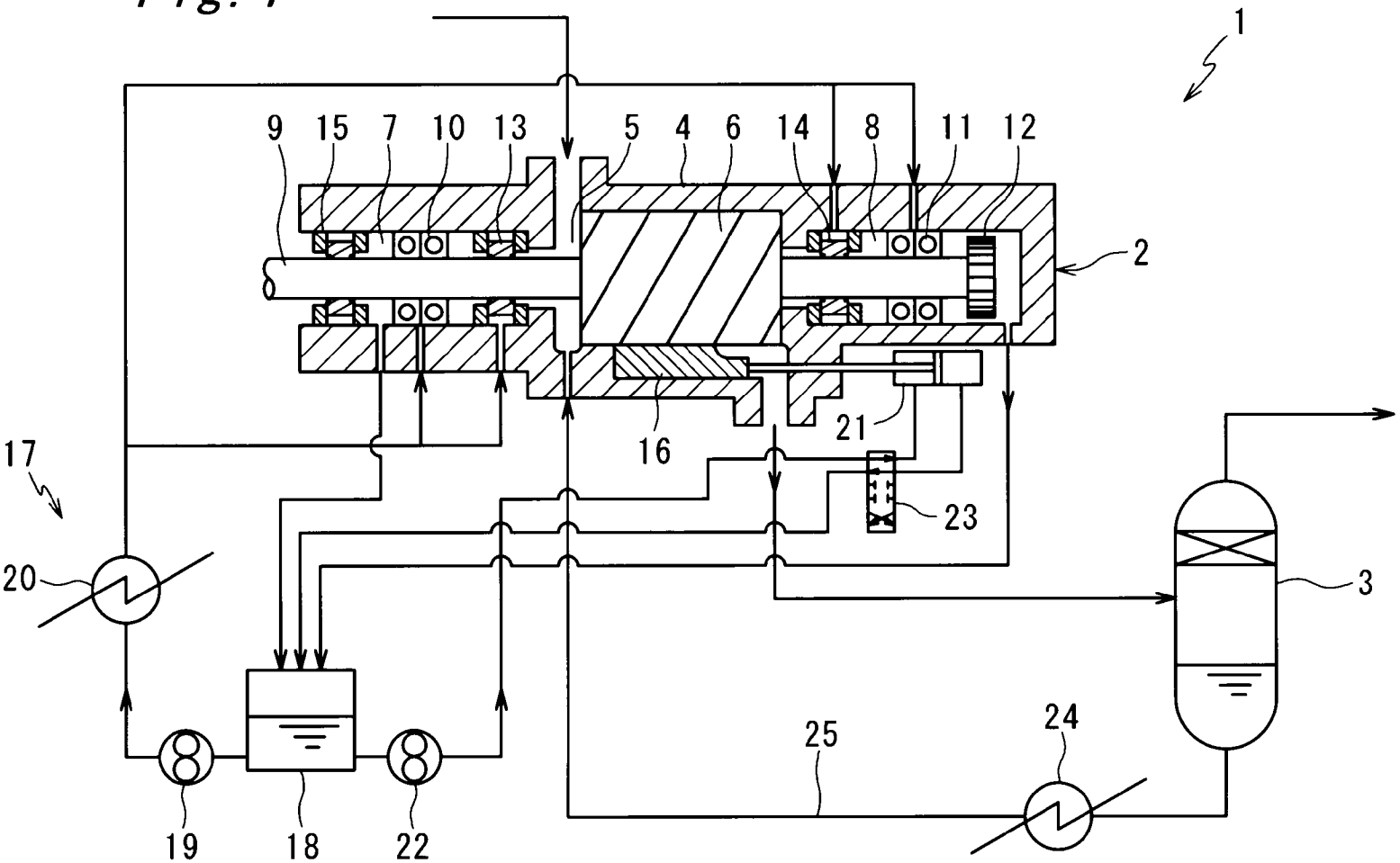
FIG. 1 is a configuration diagram of first embodiment of the present invention.

Hereinafter, an embodiment of the present invention will be described referring to the drawings. FIG. 1 shows a screw compression apparatus 1 as first embodiment of the present invention. The screw compression apparatus 1 is provided with a screw compressor 2 which compresses and discharge a target gas (for instance, propane gas), and a lubricating fluid separating collector 3 which separates rotor lubricating fluid (for instance, lubricating oil) that is mixed in the target gas for lubricating and cooling inside of the screw compressor 2 from the target gas so as to feed the compressed target gas to a consuming facility.

The screw compressor 2 has screw rotors 6 rotatably housed in a male/female interlocking arrangement in a rotor chamber 5 formed in a housing 4. The screw rotor 6 has a screw shaft 9 extending into bearing spaces 7, 8 formed adjacent to the rotor chamber 5 in the housing 4, and is held by the bearings 10-11 disposed in the bearing spaces 7, 8. Also, the male and female screw rotors 6 are connected to each other with timing gears 12 in the bearing space 8 so as to rotate synchronously on discharging side. Further, the screw compressor 2 has mechanical seals (shaft sealing member) 13, 14 respectively separating the rotor chamber 5 and bearing spaces 7, 8, and a mechanical seal 15 sealing open end of the bearing space 7 on suction side where the rotor shaft 9 protrudes outside to be connected to an unshown motor. Moreover, the screw compressor 2 has a slide valve 16 which varies an opening position on discharging side of the rotor chamber 5.

Further, the screw compression apparatus 1 has a bearing lubricating system 17 which supplies bearing lubricating fluid (for instance, lubricating oil) to the bearing spaces 7, 8 to lubricate the bearings 10-11. The bearing lubricating system 17 has a feeding tank 18 which recovers the bearing lubricating fluid flowed out from the bearing spaces 7, 8, a lubricating pump 19 which feeds the bearing lubricating fluid out from the feeding tank 18, and a cooler 20 which cools down the bearing lubricating fluid discharged from the lubricating pump 19. The screw compression apparatus 1 is configured to use the bearing lubricating fluid also as a working medium of the hydraulic cylinder 21 driving the slide valve 16. Specifically, the screw compression apparatus 1 has a driving pump 22 which pumps the bearing lubricating fluid out from the feeding tank 18, and a 3-position valve 23 which chooses one of two ports of the hydraulic cylinder 21 as to be supplied with the bearing lubricating fluid pumped by the driving pump 22.

Furthermore, the screw compression apparatus 1 has a rotor lubricating flow channel (rotor lubricating fluid feeding means) 25 for returning the rotor lubricating fluid separated from the target gas by the lubricating fluid separating collector 3 to suction part of the rotor chamber 5 of the screw compressor 2 through the cooler 24 with the pressure of the target gas. Thereby, the rotor lubricating fluid is circulated within the screw compression apparatus 1.

In the screw compression apparatus 1, the bearing lubricating fluid is also supplied into the mechanical seals 13, 14. The mechanical seals 13, 14 respectively consist of two stators sealingly fixed to the housing 4, and a rotor sealingly fixed to the rotor shaft 9 between the two stators so as to revolve together with the rotor shaft 9, the stator and the rotor slidingly contacting with each other. By supplying the bearing lubricating fluid to the sliding faces of the stator and the rotor, sealing between the stator and the rotor is completed so that the rotor chamber 5 and the bearing spaces 7, 8 are isolated form each other. Notably, the bearing lubricating fluid supplied into the mechanical seals 13, 14 are trapped within enclosed spaces formed by the stator and the rotor, and therefore the bearing lubricating fluid does not leak from the mechanical seals 13, 14 into the rotor chamber 5 or the bearing spaces 7, 8.

In the screw compression apparatus 1, since the target gas does not intrude into the bearing spaces 7, 8, there is no risk to reduce the lifespan of the bearings 10, 11 by corrosion due to the corrosivity of the target gas. Further, the bearing lubricating fluid is circulated in the separated system from the rotor lubricating fluid so as not to contact with the target gas and the rotor lubricating fluid. Consequently, the bearing lubricating fluid is not deteriorated (viscosity reduction) and an optimum condition for lubricating and cooling the bearings 9, 10 can be maintained.

Alternatively, in this embodiment, with omitting the timing gear 12, the screw rotors 6 may be synchronously rotated by mutual interlocking of the screw rotors 6.

Figure 2:
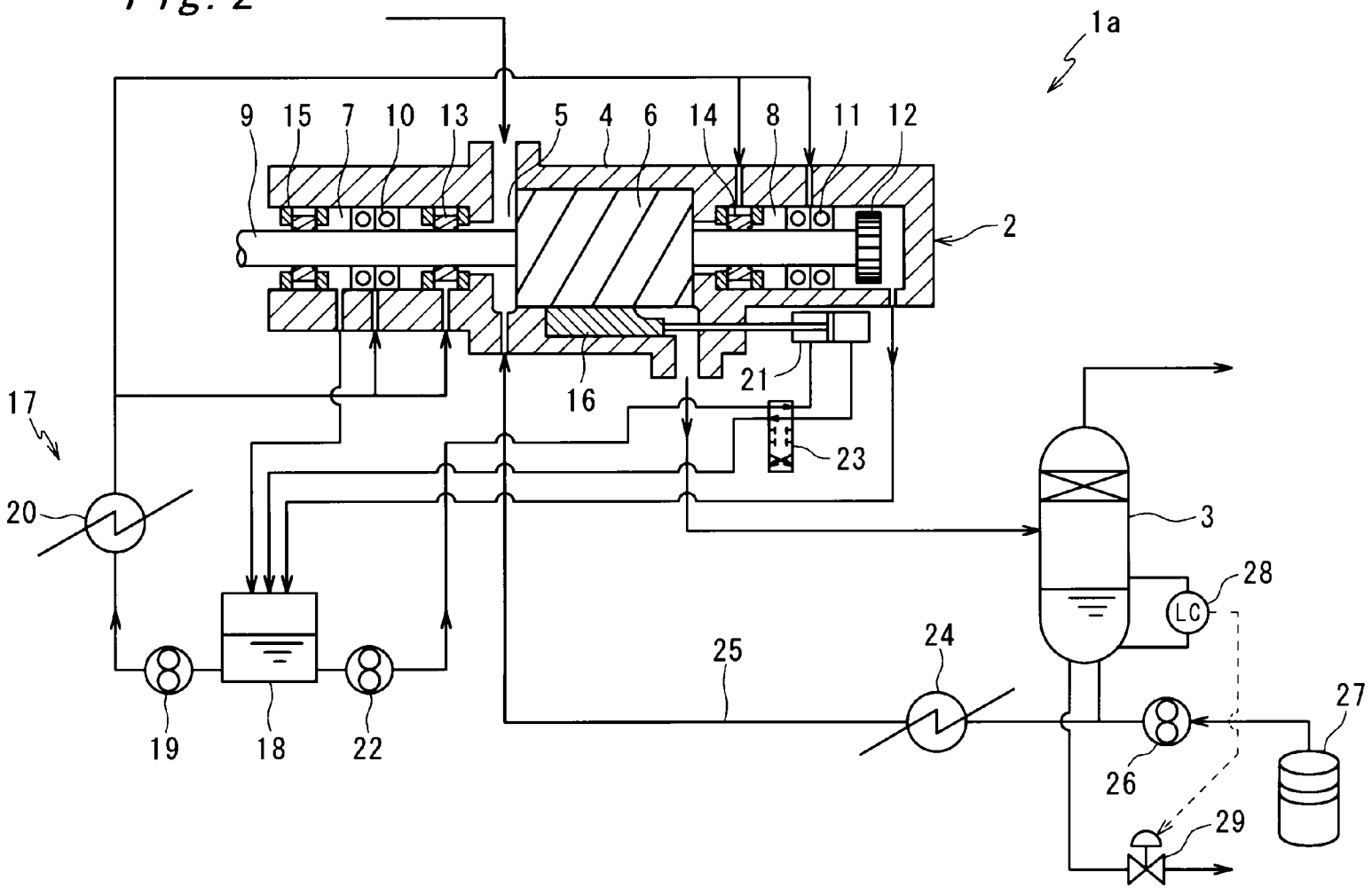
FIG. 2 is a configuration diagram of second embodiment of the present invention.

FIG. 2 shows a screw compression apparatus 1*a* as second embodiment of the present invention. It is noted that in descriptions below, components same as in embodiments described before are designated by same numerals to omit redundant descriptions.

The screw compression apparatus 1*a* is consistently supplied with a constant amount of rotor lubricating fluid by a volumetric supply pump 26 from a reservoir 27. Since the amount of fluid supplied from the supply pump 26 is small, the screw compressor 2 is supplied with the lubricating fluid also from separating collector 3. The lubricating fluid separating collector 3 has a level switch 28, and is configured to control the degree of opening of an ejection valve 29 that ejects the rotor lubricating fluid from the lubricating fluid separating collector 3 so that the fluid level in the lubricating fluid separating collector 3 is maintained within the predetermined range.

In case that the target gas is a gas including a corrosive component and the rotor lubricating fluid is a lubricating oil, the target gas gradually dissolves in the rotor lubricating fluid to cause a deterioration of the rotor lubricating fluid, with operation of the screw compression apparatus 1*a*. However, in this embodiment, fresh rotor lubricating fluid is consistently supplied and therefore the rotor lubricating fluid can be maintained at a quality higher than a certain level.

Further, the rotor lubricating fluid ejected from the screw compression apparatus 1*a* may be consumed in another plant. For instance, a petroleum refining plant consumes liquid heavy hydrocarbon which can be used as the rotor lubricating fluid. Thereby, waste liquid treatment will not be required for the rotor lubricating fluid ejected from the screw compression apparatus 1*a* using liquid heavy hydrocarbon as the rotor lubricating fluid.

Figure 3:
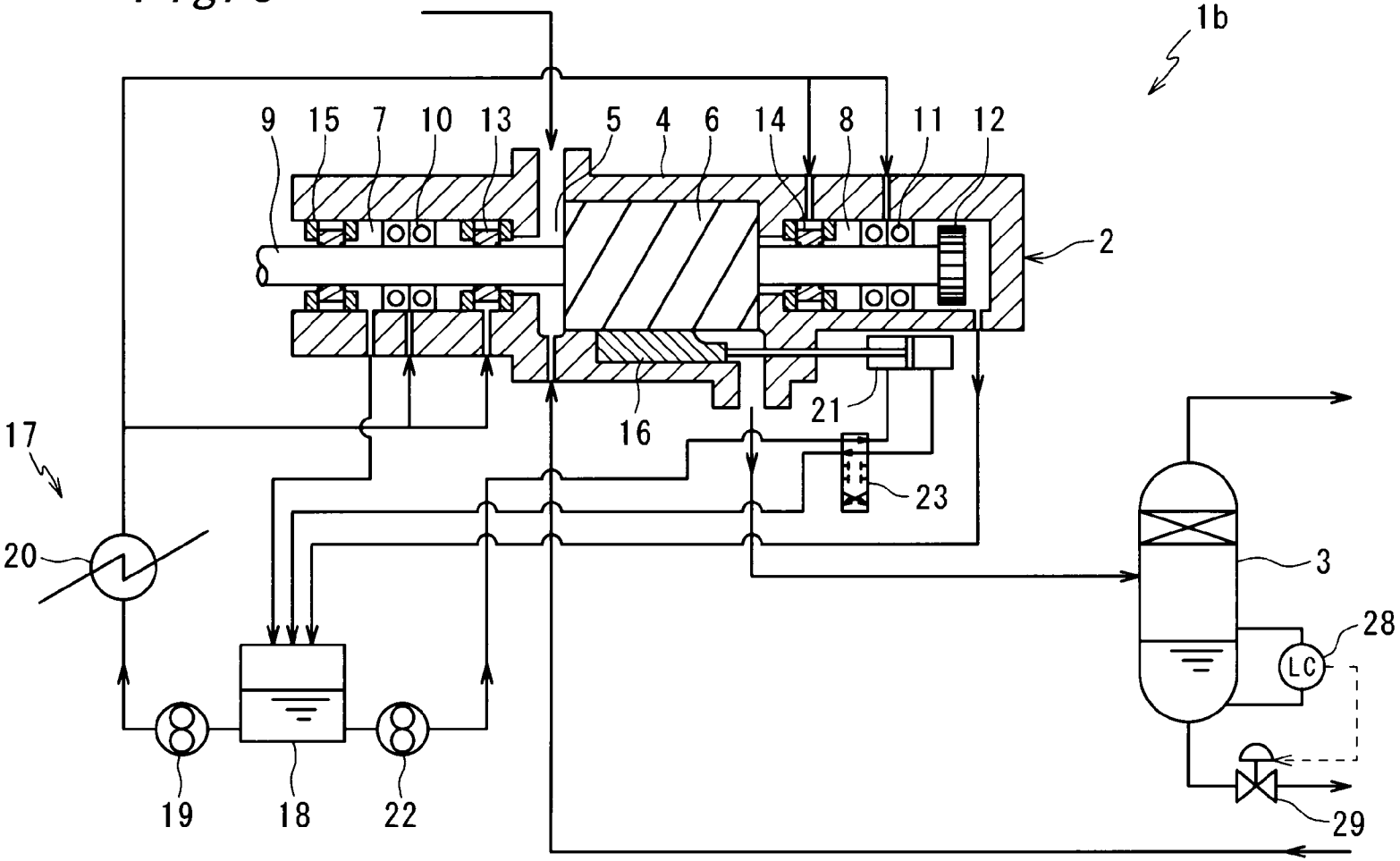
FIG. 3 is a configuration diagram of third embodiment of the present invention.

FIG. 3 shows a screw compression apparatus 1*b* as third embodiment of the present invention. In this embodiment, total amount of the rotor lubricating fluid supplied to the rotor chamber 5 of the screw compressor 2 is supplied from outside of the screw compression apparatus 1*b*, and the total amount of the rotor lubricating fluid collected in the lubricating fluid separating collector 3 is discharged to outside of the screw compression apparatus 1*b*.

For instance, a petroleum refining plant generates liquid heavy hydrocarbon such as octane as a by-product. Generally, the liquid heavy hydrocarbon is subjected to a refining treatment. But, in the screw compression apparatus 1*b* as this embodiment, the liquid heavy hydrocarbon is subjected to a refining treatment after used as the rotor lubricating fluid, and therefore the target gas dissolved in the rotor lubricating fluid is simultaneously subjected to the treatment so that there is no risk of environment pollution.

Figure 4:
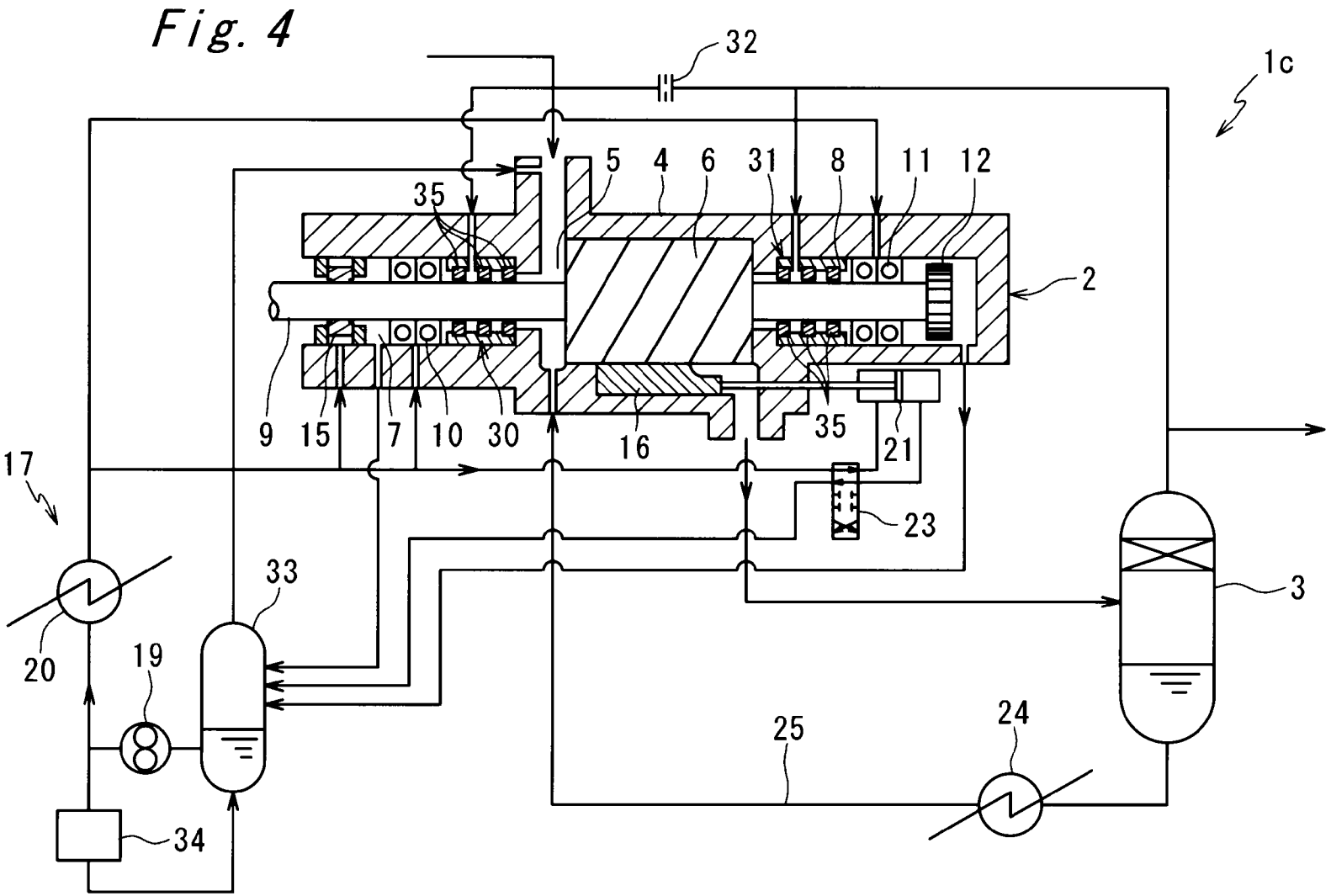
FIG. 4 is a configuration diagram of forth embodiment of the present invention.

Additionally, FIG. 4 shows a screw compression apparatus 1*c* as forth embodiment of the present invention. The screw compression apparatus 1*c* is provided with carbon ring seals 30, 31 for shaft sealing between the rotor chamber 5 and the bearing space 7, 8. Further, the screw compression apparatus 1*c* introduces a part of the target gas from which the rotor lubricating fluid is separated in the lubricating fluid separating collector 3 into midstream in the carbon ring seals 30, 31. It is noted that the target gas is supplied through an orifice 32 to the midstream of the carbon ring seal on suction side so as to adjust supplying amount of the rotor lubricating fluid.

In this embodiment, not only the bearing lubricating fluid but also a part of the target gas supplied to the carbon ring seals 30, 31 flow out from the bearing space 7, 8. These target gases are collected in a pressure tank 33. The pressure tank 33 has an upper space communicating with suction side of the screw compressor 2 so that the target gas in the upper space is sucked by the suction pressure of the screw compressor 2 to keep inner pressure of the pressure tank 33 same as the suction pressure of the screw compressor 2. Further, a part of the bearing lubricating fluid discharged from the lubricating pump 19 is returned to the pressure tank 33 through a refining device 34. Thereby the dissolved target gas is eliminated so as to keep a quality of the bearing lubricating fluid.

The carbon ring seals 30, 31 have a plurality of carbon rings 35 sealingly held by the housing to form tiny gaps between with the rotor shaft 9 so as to limit amount of the target gas passing through the gaps in a minimum amount resulted from pressure loss caused during the target gas passes through the gaps between the rotor shaft 9 and the carbon rings 35.

Further, in this embodiment, the target gas at a higher pressure than that of the rotor chamber 5 and the bearing spaces 7, 8 is introduced into the midstream of the carbon ring seals 30, 31. Therefore, the target gas introduced into the midstream of the carbon ring seals 30, 31 flows into the rotor chamber 5 and the bearing spaces 7, 8 to prevent the target gas involving the rotor lubricating fluid from intruding into the bearing spaces 7, 8 from the rotor chamber 5. Consequently, the bearing lubricating fluid is never mixed with the rotor lubricating fluid.

Furthermore, the target gas flowing into the bearing spaces 7, 8 is not a carrier medium of any lubricating fluid in this embodiment, and therefore its flow rate can be very low. Accordingly, the target gas does not have so big effect to the bearing lubricating fluid in this embodiment, and therefore the quality of the bearing lubricating fluid can be maintained by a compact refining device 34.

In this embodiment, completely air-tight shaft seal may be only the mechanical seal 15 disposed at a region where the rotor shaft 9 is protruding from the housing 4. Further, for the bearing lubricating fluid contacting with the target gas as in this embodiment, a strict standard such as standard for lubricating system by American Petroleum Institute is not required, and therefore a construction for the lubrication will not be a cost factor.

REFERENCE SIGNS LIST

1 . . . screw compression apparatus
2 . . . screw compressor
3 . . . lubricating fluid separating collector
4 . . . housing
5 . . . rotor chamber
6 . . . screw rotor
7, 8 . . . bearing space
9 . . . rotor shaft
10, 11 . . . bearing
13, 14 . . . mechanical seal (shaft sealing member)
15 . . . mechanical seal
16 . . . slide valve
17 . . . bearing lubricating system
19 . . . lubricating pomp
20 . . . cooler
21 . . . rotor lubricating flow channel
24 . . . cooler
25 . . . rotor lubricating flow channel (rotor lubricating fluid feeding means)
30, 31 . . . carbon ring seal (shaft sealing member)
35 . . . carbon ring

What is claimed is:

1. A screw compression apparatus comprising:

a screw compressor housing providing a rotor chamber;

a plurality of rotors provided in said rotor chamber, each of said rotors being rotatably supported on a rotor shaft, wherein the rotors are provided in a male/female interlocking arrangement to compress a target gas in the rotor chamber by rotation of the rotors on the respective rotor shafts;

a bearing space formed in the compressor housing adjacent to the rotor chamber;

a bearing provided in said bearing space and rotatably supporting one of said rotor shafts;

a shaft sealing member provided in the bearing space between the bearing and the rotor chamber;

a lubricating fluid separating collector which separates rotor lubricating fluid discharged from the rotor chamber from the target gas discharged from the rotor chamber;

rotor lubricating fluid feeding means which introduces the rotor lubricating fluid separated by the lubricating fluid separating collector into the rotor chamber; and a bearing lubricating system which supplies a bearing lubricating fluid to the bearing space, and returns bearing lubricating fluid discharged from the bearing space back into the bearing space, wherein the bearing lubricating system is fluidically isolated from the lubricating fluid separating collector and the rotor lubricating fluid feeding means.

2. The screw compression apparatus recited in claim 1, further comprises a rotor lubricating fluid flow channel through which the rotor lubricating fluid collected in the lubricating fluid separating collector us returned into the rotor chamber.

3. The screw compression apparatus described in claim 1, further comprising a conduit for supplying the bearing lubricating fluid to the shaft sealing member.

4. The screw compression apparatus described in claim 1, further comprising a slide valve driven by a fluid actuator, which slide valve controls a discharging quantity of the target gas from the rotor chamber.

5. The screw compression apparatus described in claim 4, wherein the bearing lubricating fluid is supplied to the fluid actuator, whereby the bearing lubricating fluid also serves as a working medium for the slide valve actuator.

6. The screw compression apparatus described in claim 1, wherein the shaft sealing member comprises two sealing stators fixed to the housing and a sealing rotor fixed to the rotor shaft and provided in a space between the sealing stators and in sliding contact with the sealing stators, wherein the bearing lubricating system supplying the bearing lubricating fluid to the bearing space is configured to supply the bearing lubricating fluid to the space between the sealing stators.

7. A screw compression apparatus comprising:

a screw compressor housing providing a rotor chamber;

a plurality of rotors provided in said rotor chamber, each of said rotors being rotatably supported on a rotor shaft, wherein the rotors are provided in a male/female interlocking arrangement to compress a target gas in the rotor chamber by rotation of the rotors on the respective rotor shafts;

a bearing space formed in the compressor housing adjacent to the rotor chamber;

a bearing provided in said bearing space and rotatably supporting one of said rotor shafts;

a shaft sealing member provided in the bearing space between the bearing and the rotor chamber;

a lubricating fluid separating collector which separates rotor lubricating fluid discharged from the rotor chamber from the target gas discharged from the rotor chamber;

rotor lubricating fluid feeding means which introduces the rotor lubricating fluid separated by the lubricating fluid separating collector into the rotor chamber;

a conduit for supplying a bearing lubricating fluid to the shaft sealing member; and a bearing lubricating system which supplies the bearing lubricating fluid to the bearing space, and returns bearing lubricating fluid discharged from the bearing space back into the bearing space, wherein the shaft sealing member comprises a plurality of carbon rings configured to fluidically isolate the bearing space from the rotor chamber such that the target gas in the rotor chamber does not reach the bearing provided in said bearing space, and wherein a part of the target gas from which the rotor lubricating fluid is separated in the lubricating fluid separating collector is supplied to said shaft sealing member at a location between said carbon rings.

* * * * *